US011306724B2

(12) United States Patent
Murtagh

(10) Patent No.: US 11,306,724 B2
(45) **Date of Patent: *Apr. 19, 2022**

(54) FLUID PUMP ASSEMBLY

(71) Applicant: Water Pressure Technologies LLC, Holmdel, NJ (US)

(72) Inventor: Christopher Murtagh, Holmdel, NJ (US)

(73) Assignee: Water Pressure Technologies LLC, Holmdel, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/181,531

(22) Filed: Feb. 22, 2021

(65) Prior Publication Data

US 2021/0172442 A1 Jun. 10, 2021

Related U.S. Application Data

(63) Continuation of application No. 16/361,643, filed on Mar. 22, 2019, now Pat. No. 10,927,838.

(51) Int. Cl.

| | |
|---|---|
| ***F04D 13/06*** | (2006.01) |
| ***E03C 1/04*** | (2006.01) |
| ***F04D 15/00*** | (2006.01) |
| ***F04D 29/62*** | (2006.01) |
| *F04D 29/42* | (2006.01) |

(52) U.S. Cl.

CPC ..... *F04D 13/068* (2013.01); *E03C 1/0408* (2013.01); *F04D 15/0066* (2013.01); *F04D 29/628* (2013.01); *F04D 29/4293* (2013.01); *F05B 2270/101* (2013.01)

(58) Field of Classification Search

CPC .... F04D 13/068; F04D 13/0693; F04D 13/06; F04D 15/0066; F04D 29/628; F04D 29/4293; F05B 2270/101; E03C 1/0408

See application file for complete search history.

(56) References Cited

U.S. PATENT DOCUMENTS

| | | | |
|---|---|---|---|
| 2,640,724 | A | 6/1953 | Sanders et al. |
| 3,097,606 | A | 7/1963 | Finzel |
| 3,114,164 | A | 12/1963 | Riordan |
| 3,383,044 | A | 5/1968 | Norstrud et al. |
| 4,792,096 | A | 12/1988 | Gregory |

(Continued)

FOREIGN PATENT DOCUMENTS

| | | |
|---|---|---|
| GB | 2173344 | 10/1986 |
| GB | 2192335 A | 1/1988 |
| GB | 2272023 A | 4/1994 |

*Primary Examiner* — Janie M Loeppke

(74) *Attorney, Agent, or Firm* — Kane Kessler, P.C.; Barry E. Negrin; Paul E. Szabo

(57) ABSTRACT

A self contained battery operated pump assembly to be installed in fluid communication between a shower arm and a shower head includes a pump; a pump motor connected with the pump for, when energized, driving the pump; and a battery that is electrically connected with the pump motor for energizing the pump motor. An inlet fitting is in fluid communication with the pump for directing water from the shower arm to the pump, the inlet fitting being configured for connection with the shower arm. An outlet fitting is in fluid communication with the pump for directing water under pressure from the pump to the shower head, the outlet fitting being configured for connection with the shower head.

18 Claims, 4 Drawing Sheets

(56) References Cited

U.S. PATENT DOCUMENTS

| | | | |
|---|---|---|---|
| 5,065,942 | A | 11/1991 | Shannon |
| 5,111,538 | A | 5/1992 | Chapman |
| 5,121,511 | A | 6/1992 | Sakamoto et al. |
| 6,290,469 | B1 | 9/2001 | Archibald |
| 6,688,855 | B2 | 2/2004 | Beckerman |
| 6,705,534 | B1 | 3/2004 | Mueller |
| 7,325,747 | B2 | 2/2008 | Jonte |
| 7,854,398 | B2 | 12/2010 | Hahn et al. |
| 8,028,355 | B2 | 10/2011 | Reeder et al. |
| 2003/0026712 | A1 | 2/2003 | Beckerman |
| 2014/0369867 | A1 | 12/2014 | Prior et al. |
| 2015/0053790 | A1 | 2/2015 | Hanna et al. |
| 2015/0089734 | A1 | 4/2015 | Bemgard |
| 2015/0159657 | A1 | 6/2015 | Roussel et al. |
| 2015/0204334 | A1 | 7/2015 | Stiles, Jr. et al. |
| 2016/0333883 | A1 | 11/2016 | Perrone et al. |
| 2018/0094624 | A1* | 4/2018 | Kabasta, Jr. ..... F04D 13/068 |

* cited by examiner

FLUID PUMP ASSEMBLY

RELATED APPLICATIONS

Priority is claimed from U.S. patent application Ser. No. 16/361,643 filed Mar. 22, 2019 and entitled "Fluid Pump Assembly", the entirety of which is incorporated by reference herein.

BACKGROUND OF THE INVENTION

This invention relates to a self-contained battery operated pump for increasing the pressure of water flowing from a device such as a shower head. Often such devices provide water at a pressure that is lower than desired. For example, a shower may be located on an upper floor of a building, far from the water supply origin and pressure source. The present invention addresses such a problem.

SUMMARY OF THE INVENTION

In one embodiment, the invention relates to a pump assembly to be installed in fluid communication between a shower arm and a shower head includes a pump; a pump motor connected with the pump for, when energized, driving the pump; a battery that is electrically connected with the pump motor for energizing the pump motor; an inlet fitting in fluid communication with the pump for directing water from the shower arm to the pump, the inlet fitting being configured for connection with the shower arm; and an outlet fitting in fluid communication with the pump for directing water under pressure from the pump to the shower head, the outlet fitting being configured for connection with the shower head.

In another embodiment, the invention relates to a method includes the steps of removing a shower head from a shower arm; installing a cordless electric pump assembly on the shower arm; installing the shower head on the cordless electric pump; and activating the cordless electric pump to direct water from the shower arm through the pump assembly and thence through the shower head at a second pressure that is greater than the first pressure.

BRIEF DESCRIPTION OF THE DRAWINGS

Further features of the invention will become apparent to one of ordinary skill in the art to which the invention pertains, from a reading of the following description of embodiments of the invention together with the accompanying drawings, in which.

DESCRIPTION OF EMBODIMENTS OF THE INVENTION

The present invention relates to a pump for increasing the pressure of water flowing from a device such as a shower head. The invention is applicable to pumps of various configurations. As representative of the invention, the drawings illustrate a pump assembly 10 that is a first embodiment of the invention.

Figure 1:
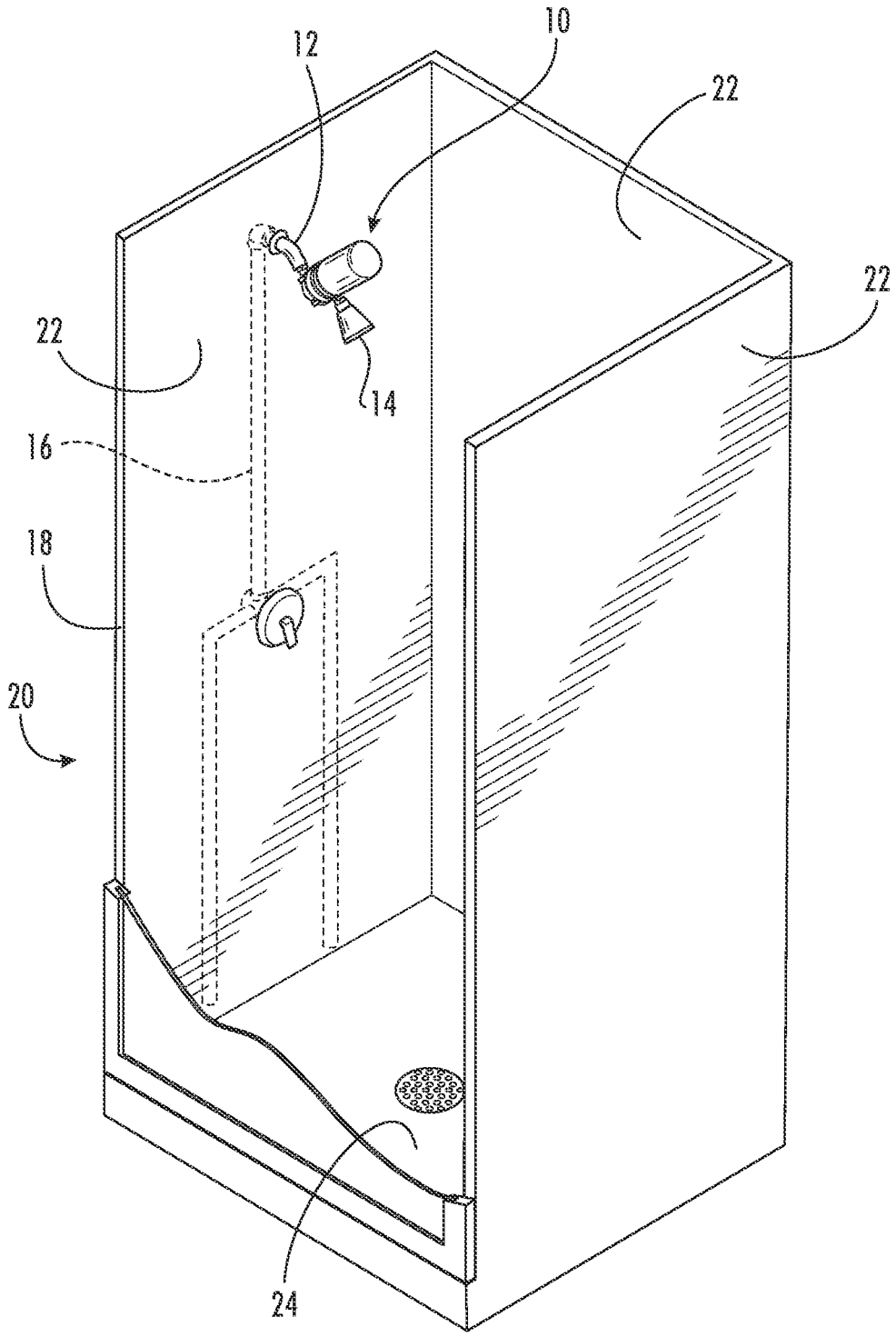
FIG. 1 is a pictorial illustration of a shower including a shower arm and shower head to which is connected a pump assembly that is a first embodiment of the invention.

The pump assembly 10 is configured to be installed in fluid communication between a known shower arm 12 (FIG. 1) and a known shower head 14. In a typical such installation for a residence or other place, as illustrated schematically in FIG. 1, a shower arm 12 is the section of the building plumbing 16 that protrudes from a wall 18 into a shower or enclosure 20 that includes walls 18 and 22, a floor 24, and a ceiling (not shown). The shower arm 12 has a male threaded connection 26 (FIG. 2B) that receives a female threaded connection 28 of the shower head 14. The connections 26 and 28 are in the US industry standard being one half inch in diameter. Specifically, there connections are ½" NPT with 5.6 threads per cm, which is 14 threads per inch (TPI).

In accordance with the invention, the pump assembly 10 is connected in fluid communication between the shower arm 12 and the shower head 14. Thus, the shower head 14 is not fastened directly onto the shower arm 12. Instead, the pump assembly 10 is fastened to the shower arm 12, and the shower head 14 is fastened to the pump assembly. The pump assembly has connection described below, that replicate the connections on the shower arm 12 and shower head 14. This feature makes it feasible for a homeowner or other person to easily install a pump assembly 10 of the present invention, without special fittings or adapters. All that is needed are the normal tools that are used for removing and reinstalling a shower head.

The pump assembly 10 includes, as its major components, a pump 30, an electric motor 40 for driving the pump, and a battery 50 for energizing the electric motor. The pump 30 that is illustrated is a centrifugal pump which includes a housing 32 defining a pump chamber 34. The pump housing 32 has an inlet connection 36 for receiving water from the shower arm 12. The inlet connection 36 may be a female threaded connection that replicates the female threaded connection 28 on the shower head 14. The pump housing 32 also has an outlet connection 38 for providing water to the shower head 14. The outlet connection 38 may be a male threaded connection that replicates the male threaded connection 26 on the shower arm 12.

An impeller 39 is rotatable inside the pump chamber 34. Rotation of the impeller 39 inside the pump chamber 34 causes pressurization of water flowing from the pump housing inlet 36 to the pump housing outlet 38, in a known manner.

It should be understood that different types of pumps can be used, other than a centrifugal pump 30 as illustrated. For example, a positive displacement pump may be suitable. Also, the inlet and outlet connections 36 and 38 need not be formed as one piece with the pump housing 32, as is shown in the illustrated embodiment.

The pump assembly 10 includes an electric motor 40 that is connected with the impeller 39. When the motor 40 is energized, the motor 40 rotates (drives) the impeller 39. The motor 40 may be of any suitable type for this wet environment. The illustrated motor 40 includes generally a housing 42 that is sealed to the pump housing 32 by an O-ring 44, and a series of windings and other elements 46 within the housing.

The battery 50 is electrically connected with the pump motor 40 for energizing the pump motor 40. The battery 50 may be a lithium ion rechargeable battery, or may be another type of battery. Because the pump assembly 10 includes the battery 50, no wiring connection is needed to the residential power supply. This increases ease of installation, as the pump assembly 10 can be fitted into almost any existing shower. This feature also increases safety, as the pump assembly 10 operates on low voltage rather than standard building wiring.

The battery 50 is contained in a removable battery housing 52. The battery housing 52 is screwed onto or otherwise connected with a speed control unit 60. The speed control unit 60 serves several purposes. First, it provides a physical and electrical connection between the battery 50 and the motor 40. Second, it enables on/off and speed control for the pump 30.

Specifically, the speed control unit 60 has an electrical connection with the battery 50 via wiring or contacts, as illustrated schematically at 62. The speed control unit 60 has electrical connection with the motor 40 via wiring or contacts, as illustrated schematically at 64. A projecting knob 66 controls an on-off switch 68 that is combined with a speed (pressure) control. The speed control unit 60 may be configured and operable to provide, for example, off, low, medium, and high pressures (speeds).

It should be understood that the electrical connection between the battery 50 and the motor 40 may be made in another suitable manner. Also, the pump assembly 10 need not include a variable speed function.

The speed control unit 60 provides a mechanical connection between the battery housing 52 and the motor housing 42. These may be threaded connections. All connections between the major components of the pump assembly 10 are watertight, for example via O-rings 44.

Figure 2A:
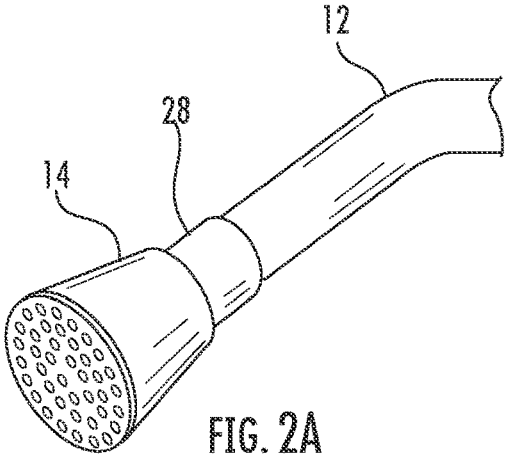
FIG. 2A is an enlarged view of the shower arm of FIG. 1 with a shower head attached.
Figure 2B:
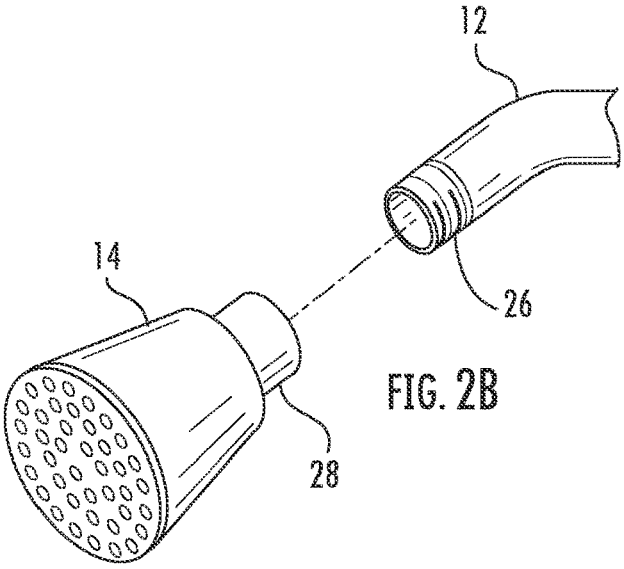
FIG. 2B is a view similar to FIG. 2A illustrating the step of removing the shower head from the shower arm.
Figure 2C:
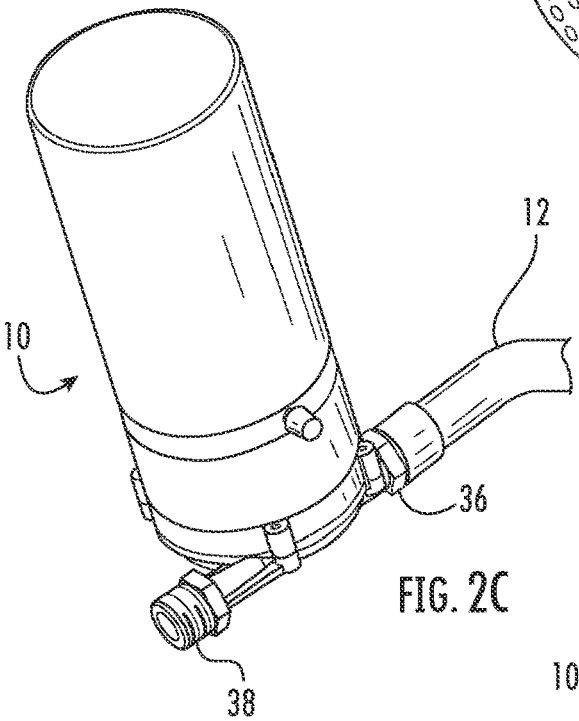
FIG. 2C illustrates the step of attaching the pump assembly to the shower arm.
Figure 2D:
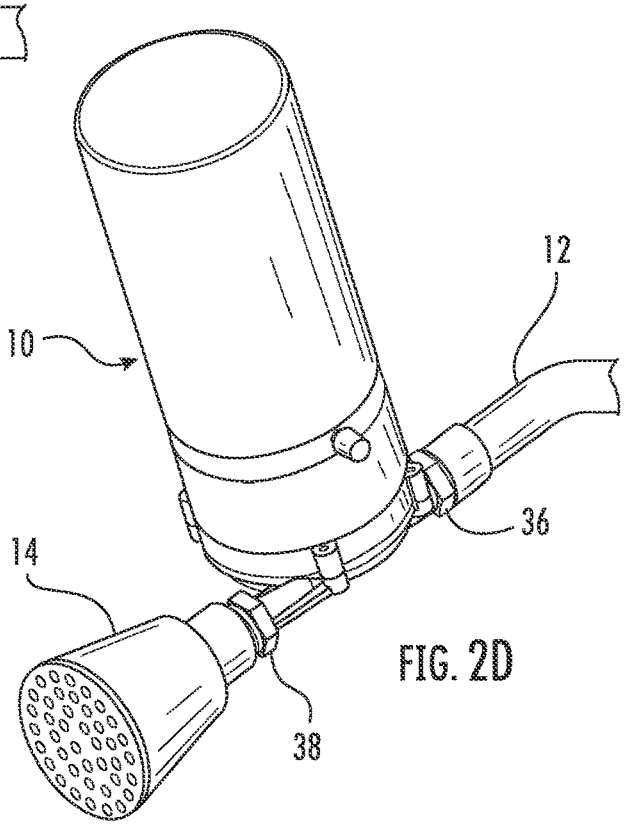
FIG. 2D illustrates the step of attaching the pump assembly to the shower arm.
Figure 3:
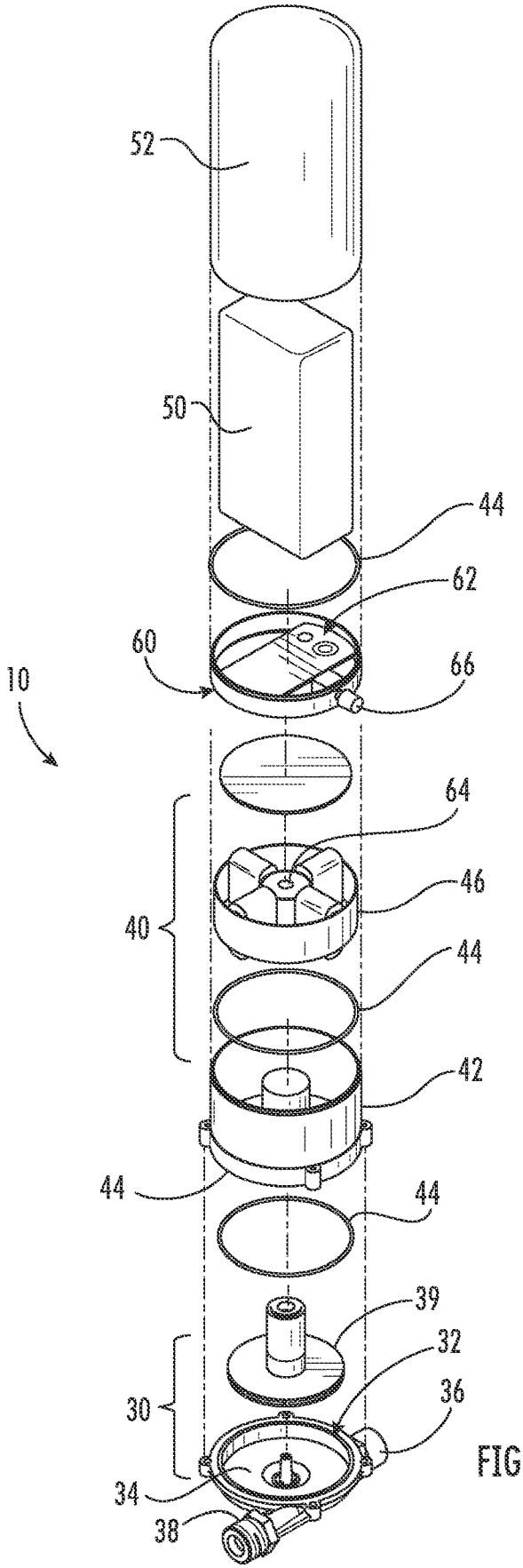
FIG. 3 is an exploded perspective view of the pump assembly.
Figure 4:
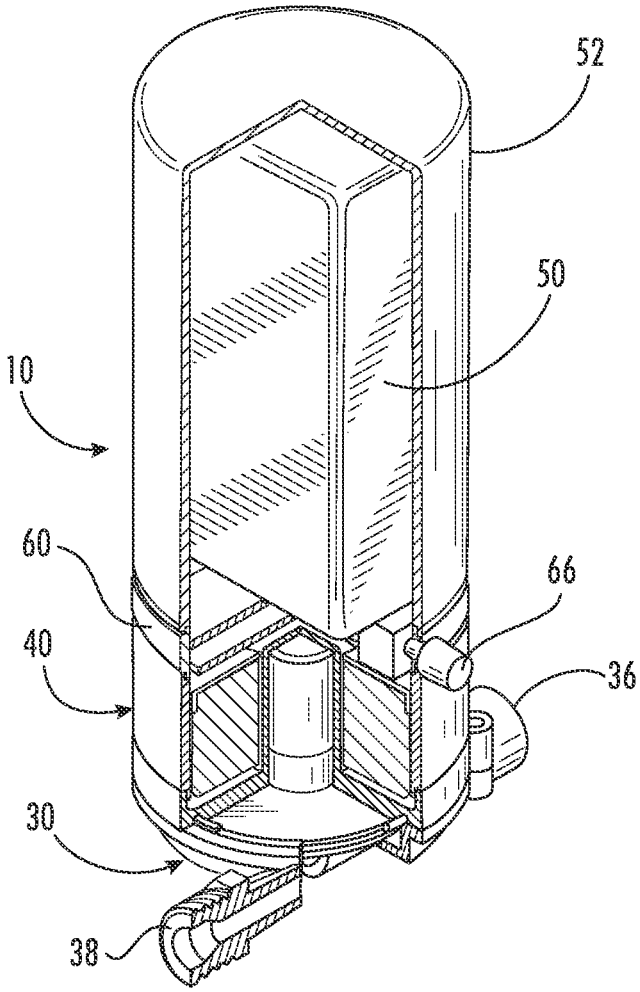
FIG. 4 is a partial sectional view of the pump assembly.
Figure 5:
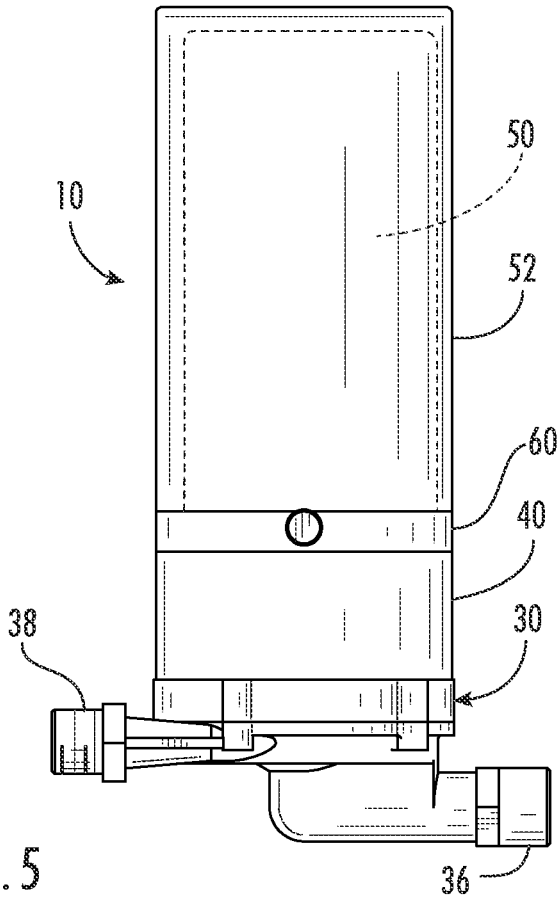
FIG. 5 is a side elevational view of the pump assembly.

FIGS. 2A-2D illustrate the process of installing the pump assembly 10 in a typical residential shower. Before the pump assembly 10 is installed, the shower head 14 (FIG. 2A) is screwed directly to the shower arm 12, as normal. To install the pump assembly 10, the shower head 14 is first removed, as shown in FIG. 2B. Then, the inlet connection 36 of the pump assembly 10 is screwed onto the shower arm 12, as shown in FIG. 2C. Finally, the shower head 14 is replaced, being screwed onto the outlet connection 38 of the pump assembly 10 as shown in FIG. 2D. The shower head 14 may alternatively be installed on the pump assembly 10 before the pump assembly 10 is connected with the shower arm 12.

The shower 20 may be used without operation of the motor 40. In that case, the water from the shower arm 12 simply flows through the pump assembly 10 without being increased in pressure.

if the user desires to increase the pressure of the water flowing from the shower head 14, the user operates the knob 66 to turn on the pump assembly 10. The motor 40 is energized, and drives the impeller 39 for rotation. Rotation of the impeller 39 results in increased pressure of the water flowing from the pump assembly 10 outlet connection 38 into the shower head 14. The amount of pressure increase can be varied by varying the speed of the motor 40 via the speed control unit 60. As one example, presets for low, medium, and high can be provided.

It can thus be seen that the present invention provides a way for a user to selectively increase the pressure of water flowing from a shower head 14, using the pump assembly 10. When the battery 50 needs recharging, the battery housing 50 can be unscrewed from the speed control unit 60, allowing the battery to be removed and taken to a charging station. The pump assembly 10 is waterproof—that is, it can be installed and safely used in the wet environment of a shower. The pump assembly is easily installed on a do it yourself basis, with no additional plumbing or wiring connections needed.

Variations on the illustrated embodiment are possible in accordance with the invention. For example, the pump assembly may be incorporated into and sold together with a shower head. All such variations within the skill of one of ordinary skill in the art are intended to be covered by the following claims.

The invention claimed is:

1. A shower pressure-increasing pump assembly configured to be installed at a location above a water stream emerging from a shower head, in fluid communication directly between the shower head and a shower arm that protrudes into a shower enclosure from a surface defining the enclosure, the pump assembly comprising:

a pump configured to increase water pressure emerging from the shower arm at a first pressure to a second higher pressure entering the shower head;

a pump motor connected with the pump for, when energized, driving the pump;

a battery that is electrically connected with the pump motor for energizing the pump motor;

an inlet fitting in fluid communication with the pump for directing water from the shower arm to the pump, the inlet fitting being configured for direct connection with the shower arm above the water stream; and an outlet fitting in fluid communication with the pump for directing water under pressure from the pump to the shower head, the outlet fitting being configured for direct connection with the shower head above the water stream.

2. A shower pressure-increasing pump assembly configured to be installed at a location above a water stream emerging from a shower head, in fluid communication directly between the shower head and the shower arm as set forth in claim 1, said inlet fitting having threaded connections for directly threadedly mating with the shower arm and said outlet fitting having threaded connections for directly threadedly mating with the shower head.

3. A shower pressure-increasing pump assembly configured to be installed at a location above a water stream emerging from a shower head, in fluid communication directly between the shower head and the shower arm as set forth in claim 1, further comprising a housing defining a pump chamber and an impeller inside the pump chamber, the impeller being driven for rotation by the pump motor, wherein the pump housing includes the inlet fitting and the outlet fitting.

4. A shower pressure-increasing pump assembly configured to be installed at a location above a water stream emerging from a shower head, in fluid communication directly between the shower head and the shower arm as set forth in claim 3, said housing further comprising a battery housing having a fluid tight battery chamber in which the battery is contained.

5. A shower pressure-increasing pump assembly configured to be installed at a location above a water stream emerging from a shower head, in fluid communication directly between the shower head and the shower arm as set forth in claim 1, further comprising a control on the pump assembly for turning the pump motor on and off, wherein the control is operable for controlling the speed of operation of the motor.

6. A shower pressure-increasing pump assembly configured to be installed at a location above a water stream emerging from a shower head, in fluid communication directly between the shower head and the shower arm as set forth in claim 1, wherein the pump assembly includes the battery in a battery housing that is secured in a watertight manner to a speed control unit, the speed control unit being secured in a watertight manner to the motor, the motor being secured in a watertight manner to the pump housing, the pump housing including the inlet fitting and the outlet fitting.

7. A shower pressure-increasing pump assembly configured to be installed at a location above a water stream emerging from a shower head, in fluid communication directly between the shower head and a shower arm that protrudes into a shower enclosure from a surface defining the enclosure, the pump assembly comprising:

a pump configured to increase water pressure emerging from the shower arm at a first pressure to a second higher pressure entering the shower head;

an inlet fitting in fluid communication with the pump for directing water from the shower arm to the pump, the inlet fitting being configured for direct connection with the shower arm above the water stream; and an outlet fitting in fluid communication with the pump for directing water under pressure from the pump to the shower head, the outlet fitting being configured for direct connection with the shower head above the water stream.

8. A shower pressure-increasing pump assembly configured to be installed at a location above a water stream emerging from a shower head, in fluid communication directly between the shower head and the shower arm as set forth in claim 7, said inlet fitting having threaded connections for directly threadedly mating with the shower arm and said outlet fitting having threaded connections for directly threadedly mating with the shower head.

9. A shower pressure-increasing pump assembly configured to be installed at a location above a water stream emerging from a shower head, in fluid communication directly between the shower head and the shower arm as set forth in claim 7, further comprising a housing defining a pump chamber, wherein the pump housing includes the inlet fitting and the outlet fitting.

10. A shower pressure-increasing pump assembly configured to be installed at a location above a water stream emerging from a shower head, in fluid communication directly between the shower head and the shower arm according to claim 9, further comprising a battery electrically connected with the pump for energizing the pump.

11. A shower pressure-increasing pump assembly configured to be installed at a location above a water stream emerging from a shower head, in fluid communication directly between the shower head and the shower arm as set forth in claim 10, said housing further comprising a battery housing having a fluid tight battery chamber in which the battery is contained.

12. A shower pressure-increasing pump assembly configured to be installed at a location above a water stream emerging from a shower head, in fluid communication directly between the shower head and the shower arm as set forth in claim 7, further comprising a pump motor connected with the pump for, when energized, driving the pump.

13. A shower apparatus mountable on a shower arm that protrudes into a shower enclosure from a surface defining the enclosure and configured to increase water pressure emerging from the shower arm at a first pressure to a second higher pressure, the apparatus comprising:

a pump assembly configured to be mounted in fluid communication with and directly to a fluid outlet of the shower arm; and a shower head having a fluid inlet directly connected in fluid communication with the pump assembly;

the pump assembly comprising:

a pressurizing pump for increasing water pressure from the first pressure to the second pressure higher than the first pressure;

an inlet fitting configured for direct connection with the shower arm, the inlet fitting receiving water at the first pressure from the shower arm; and an outlet fitting configured for direct connection with the shower head, the outlet fitting directing water at the second pressure higher than the first pressure from the pump to the shower head, wherein the pump assembly is configured to be installed at a location above a water stream emerging from the shower head.

14. A shower apparatus mountable on a shower arm and configured to increase water pressure emerging from the shower arm at a first pressure to a second higher pressure as set forth in claim 13, said inlet fitting having threaded connections for directly threadedly mating with the shower arm and said outlet fitting having threaded connections for directly threadedly mating with the shower head.

15. A shower apparatus mountable on a shower arm and configured to increase water pressure emerging from the shower arm at a first pressure to a second higher pressure as set forth in claim 13, further comprising a housing defining a pump chamber, wherein the pump housing includes the inlet fitting and the outlet fitting.

16. A shower apparatus mountable on a shower arm and configured to increase water pressure emerging from the shower arm at a first pressure to a second higher pressure as set forth in claim 15, further comprising a battery electrically connected with the pump for energizing the pump.

17. A shower apparatus mountable on a shower arm and configured to increase water pressure emerging from the shower arm at a first pressure to a second higher pressure as set forth in claim 16, said housing further comprising a battery housing having a fluid tight battery chamber in which the battery is contained.

18. A shower apparatus mountable on a shower arm and configured to increase water pressure emerging from the shower arm at a first pressure to a second higher pressure as set forth in claim 13, further comprising a pump motor connected with the pump for, when energized, driving the pump.

* * * * *